US009121206B2

(12) United States Patent
Shimizu et al.

(10) Patent No.: US 9,121,206 B2
(45) Date of Patent: Sep. 1, 2015

(54) LOCKING DEVICE FOR CLOSING-OPENING MEMBER

(75) Inventors: Toshihiro Shimizu, Yokohama (JP); Satoru Tamaki, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 0 days.

(21) Appl. No.: 14/006,301

(22) PCT Filed: Feb. 3, 2012

(86) PCT No.: PCT/JP2012/052469

§ 371 (c)(1),
(2), (4) Date: Sep. 19, 2013

(87) PCT Pub. No.: WO2012/132546

PCT Pub. Date: Oct. 4, 2012

(65) Prior Publication Data

US 2014/0008921 A1 Jan. 9, 2014

(30) Foreign Application Priority Data

Mar. 31, 2011 (JP) ..... 2011-077872

(51) Int. Cl.

| | |
|---|---|
| ***E05C 1/08*** | (2006.01) |
| ***E05C 9/04*** | (2006.01) |
| ***E05B 63/14*** | (2006.01) |
| ***E05B 63/22*** | (2006.01) |

(Continued)

(52) U.S. Cl.

CPC ..... *E05C 9/042* (2013.01); *E05B 63/14* (2013.01); *E05B 63/22* (2013.01); *E05C 21/00* (2013.01); *Y10T 292/0961* (2015.04)

(58) Field of Classification Search

USPC ..... 292/156, 137, 157, 158

See application file for complete search history.

(56) References Cited

U.S. PATENT DOCUMENTS

| | | | | |
|---|---|---|---|---|
| 7,048,311 | B2 * | 5/2006 | Sawatani et al. | 292/33 |
| 2004/0168487 | A1 | 9/2004 | Sawatani et al. | |

(Continued)

FOREIGN PATENT DOCUMENTS

| | | | |
|---|---|---|---|
| CN | 1944930 | A | 4/2007 |
| CN | 101103162 | A | 1/2008 |
| CN | 101769100 | A | 7/2010 |

(Continued)

OTHER PUBLICATIONS

International Search Report (ISR) (PCT Form PCT/ISA/210), in PCT/JP2012/052469, dated Apr. 24, 2012.

(Continued)

*Primary Examiner* — Mark Williams

(74) *Attorney, Agent, or Firm* — McGinn IP Law Group, PLLC

(57) ABSTRACT

An openable/closable member locking device includes a mounting base, a pivot, a rotor which is mounted rotatably on the mounting base, a pair of arms, a pair of sliding pins having proximal end portions connected to the arms and distal end portions to be inserted into and dislocated from engagement holes, a torsion coil spring which rotationally urges the rotor such that the sliding pins are inserted into the engagement holes, and a lock release unit which moves the sliding pins against an urging force of the torsion coil spring such that they are dislocated from the engagement holes, and a guide portion is provided which causes the sliding pins to slide straight along a lengthwise direction thereof.

18 Claims, 13 Drawing Sheets

(51) Int. Cl.
*E05C 21/00* (2006.01)
*E05C 1/02* (2006.01)

(56) References Cited

U.S. PATENT DOCUMENTS

| | | | |
|---|---|---|---|
| 2007/0080542 | A1 | 4/2007 | Ookawara |
| 2011/0174027 | A1 | 7/2011 | Ookawara et al. |

FOREIGN PATENT DOCUMENTS

| | | | |
|---|---|---|---|
| JP | H04-060079 | A | 2/1992 |
| JP | 2004-210260 | A | 7/2004 |
| JP | 2007-100343 | A | 4/2007 |
| JP | 2007-285021 | A | 11/2007 |
| JP | 2009-215740 | A | 9/2009 |
| JP | 2009-299268 | A | 12/2009 |
| WO | WO 2010-038716 | A1 | 4/2010 |

OTHER PUBLICATIONS

PCT/IPEA/409 (International Preliminary Report on Patentability) dated Jun. 3, 2013.
Japanese Office Action dated Mar. 17, 2015 with an English Translation.
Chinese Office Action dated Dec. 1, 2014 with an English Translation thereof.

* cited by examiner

LOCKING DEVICE FOR CLOSING-OPENING MEMBER

TECHNICAL FIELD

The present invention relates to an openable/closable member locking device which, for example, locks an openable/closable lid with respect to a cavity portion in an instrument panel of a motor vehicle.

BACKGROUND ART

For example, a glove box is provided in an instrument panel of a motor vehicle, and a lid is mounted openably/closably to a cavity portion of this glove box. There is further provided a locking device which not only locks the lid in the closed state but also brings the lid into the opened state with respect to the cavity portion of the glove box.

For example, Patent Literature 1 describes a side locking device including a rotor, a pair of rods, a knob and a return spring. The rotor is pivoted rotatably on a back side of a lid. The rods are supported such that proximal end portions are in engagement point symmetrically with respect to an axis of the rotor, and such that distal end portions appear and disappear from both sides of the lid so as to be brought into engagement with and disengagement from a circumferential edge of the cavity portion. The knob is mounted on a front side of the lid, and causes the rotor to rotate by being pushed in or pulled out. The return spring normally rotationally urges the rotor in a direction in which the rods project from both the sides of the lid. When the knob is pushed in or pulled out, the rotor rotates against the return spring, and the rods draws into the lid. Each of the proximal end portions of the rods have a frame shape, and spherical engagement portions are provided on the rotor. The spherical engagement portions are brought into engagement with the corresponding frame-shaped proximal end portions, whereby the rods are connected to the rotor.

RELATED ART LITERATURE

Patent Literature

Patent Literature 1

JP-2007-100343-A

SUMMARY OF THE INVENTION

Problem that the Invention is to Solve

In the side locking device of Patent Literature 1, the proximal end portions of the rods are in engagement point symmetrically with respect to the axis of the rotor. Thus, when the knob is operated and the rotor rotates, the proximal end portions of the rods move arcwise interlocking with the rotation of the rotor, and the rods slide while being inclined depending on the rotation angel of the rotor. As a result, the rods are brought into sliding contact strongly with guide holes provided in the lid or engagement holes provided in the circumferential edge of the cavity portion, thereby increasing the sliding resistance and/or generating abnormal noise.

An object of the invention is to provide an openable/closable member locking device which, when a rotor is rotated to cause sliding pins to slide, can prevent an increase in sliding resistance of the sliding pins to allow the sliding pins to slide smoothly while suppressing the generation of abnormal noise.

Means for Solving the Problem

To attaining the object, the invention provides, a locking device for an openable/closable member to be mounted openably/closably to a cavity portion in a platform member, including:

a mounting base which is mounted on one of the platform member and the openable/closable member;

a pivot which projects from the mounting base;

a rotor which is mounted rotatably on the mounting base via the pivot;

a pair of arms which extend radially outwards from the rotor;

a pair of sliding pins which includes:

proximal end portions connected to distal end portions of the corresponding arms; and distal end portions provided so as to be inserted into and dislocated from engagement holes provided on the other of the platform member and the openable/closable member;

a return spring which rotationally urges the rotor in a direction in which the sliding pins are inserted into the engagement holes; and a lock release unit which moves the rotor or the sliding pins against an urging force of the return spring so as to draw the sliding pins out of the engagement holes, wherein the proximal end portions of the sliding pins are connected to the distal end portions of the arms so as to have no play in a lengthwise direction of the sliding pins but have a given play in a direction perpendicular to the lengthwise direction, and wherein there is provided a guide portion which causes the sliding pins to slide straight along the lengthwise direction.

The invention may provide the locking device, wherein the guide portion includes:

an arc-shaped wall portion which is formed on an outer circumference of the rotor around the pivot; and a guide wall which erects from the mounting base so as to face the arc-shaped wall portion with a space defined therebetween, the defined space allowing the sliding pin to be inserted therein.

The invention may provide the locking device, wherein the mounting base is mounted such that the pivot projecting surface thereof is faced towards the one of the platform member and the openable/closable member in a state in which the rotor and the sliding pins are held between the mounting base and the one of the platform member and the openable/closable member.

The invention may provide the locking device, wherein a rotation restricting portion is provided on the mounting base and the rotor so as to restrict a rotational angle of the rotor in the urging direction of the return spring.

Advantage of the Invention

According to the invention, when the openable/closable member closes the cavity portion in the platform member, the sliding pins are pushed out by the urging force of the return spring so as to be inserted into the engagement holes, thereby locking the openable/closable member in the closed state.

When the lock release unit is manipulated, the rotor or the sliding pins are moved against the urging force of the return spring, and the sliding pins are drawn out of the engagement holes, thereby bringing the openable/closable member into the opened state.

The sliding pins are connected to the distal end portions of the arms of the rotor so as to have no play in the lengthwise direction of the sliding pins but have the given play in the direction perpendicular to the lengthwise direction. Therefore, when the rotor is rotated by the urging force of the return spring or by the lock release unit, even though the arms of the rotor move arcwise, the sliding pins are allowed to move straight in the lengthwise direction by the guide portion.

Thus, it is possible to prevent the increase in sliding resistance or the generation of abnormal noise which would otherwise be caused due to the inclination of the sliding pins which causes sliding contact with the engagement holes or other holes such as the guide holes.

BRIEF DESCRIPTION OF DRAWINGS

FIG. 8 is an enlarged explanatory diagram showing a state in which the sliding pins of the locking device are drawn in.

MODE FOR CARRYING OUT THE INVENTION

Hereinafter, referring to FIGS. 1 to 10, an embodiment of an openable/closable member locking member according to the invention will be described.

Figure 6:
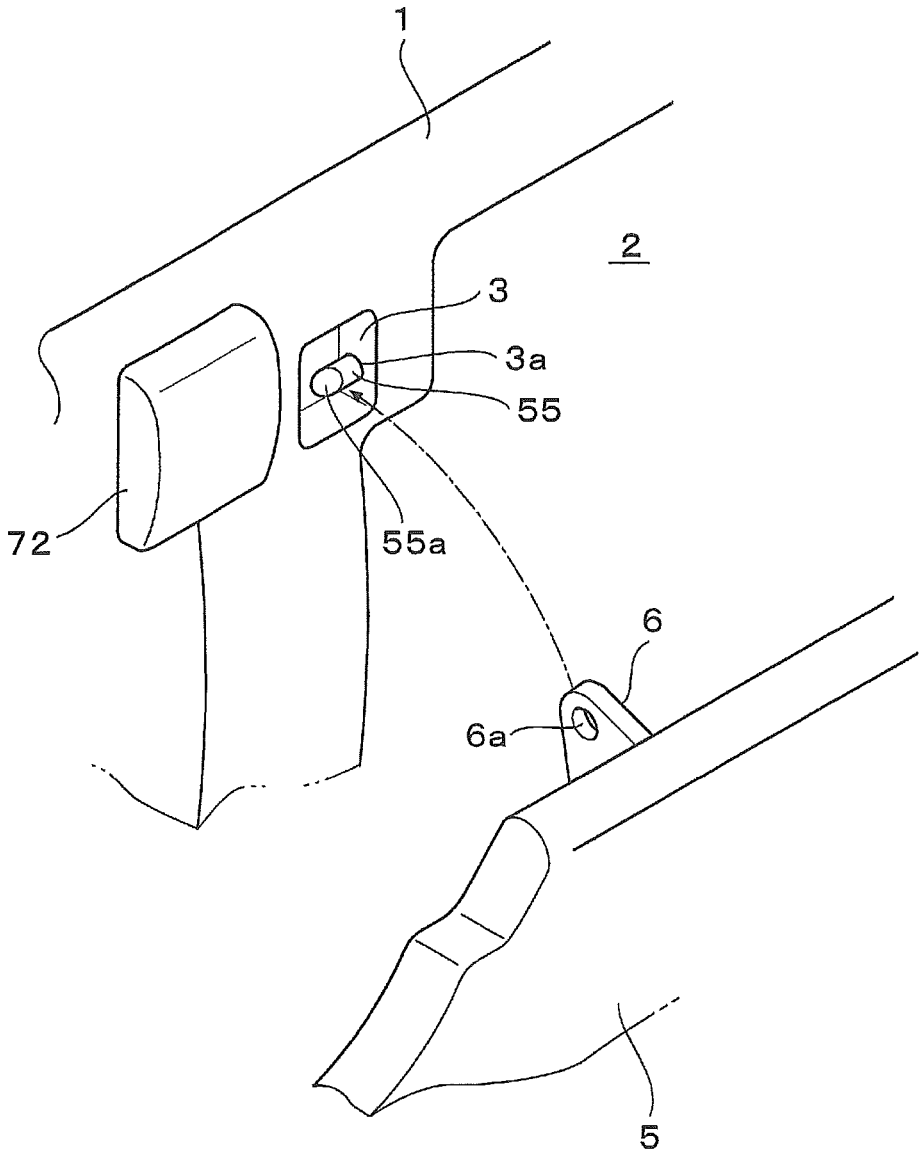
FIG. 6 is an enlarged perspective view of main parts of the platform member, on which the locking device is mounted, and an openable/closable member.

As shown in FIGS. 5, 6, 9, 10, an openable/closable member locking device (locking device) 10 according to this embodiment locks, for example, an openable/closable lid (openable/closable member) 5 with respect to a cavity portion 2 in a glove box main body (platform member) 1 which is mounted in an instrument panel of a motor vehicle. As shown in FIG. 6, recess portions 3, 3 are formed in both side upper circumferential edges of the cavity portion in the glove box main body 1, and a through hole 3*a* is formed in a side surface of each recess portion 3 so as to communicate with the cavity portion 2. A pair of guide ribs 4, 4 project from a back side of an upper wall of the glove box main body 1 (refer to FIGS. 9 and 10). On the other hand, as shown in FIG. 6, a pair of projecting portions 6, 6, which are inserted into and dislocated from the recess portions 3 of the glove box main body 1, are formed at upper portions on a back side of the lid 5, and an engagement hole 6*a* is provided in each of the projecting portions 6.

Figure 1:
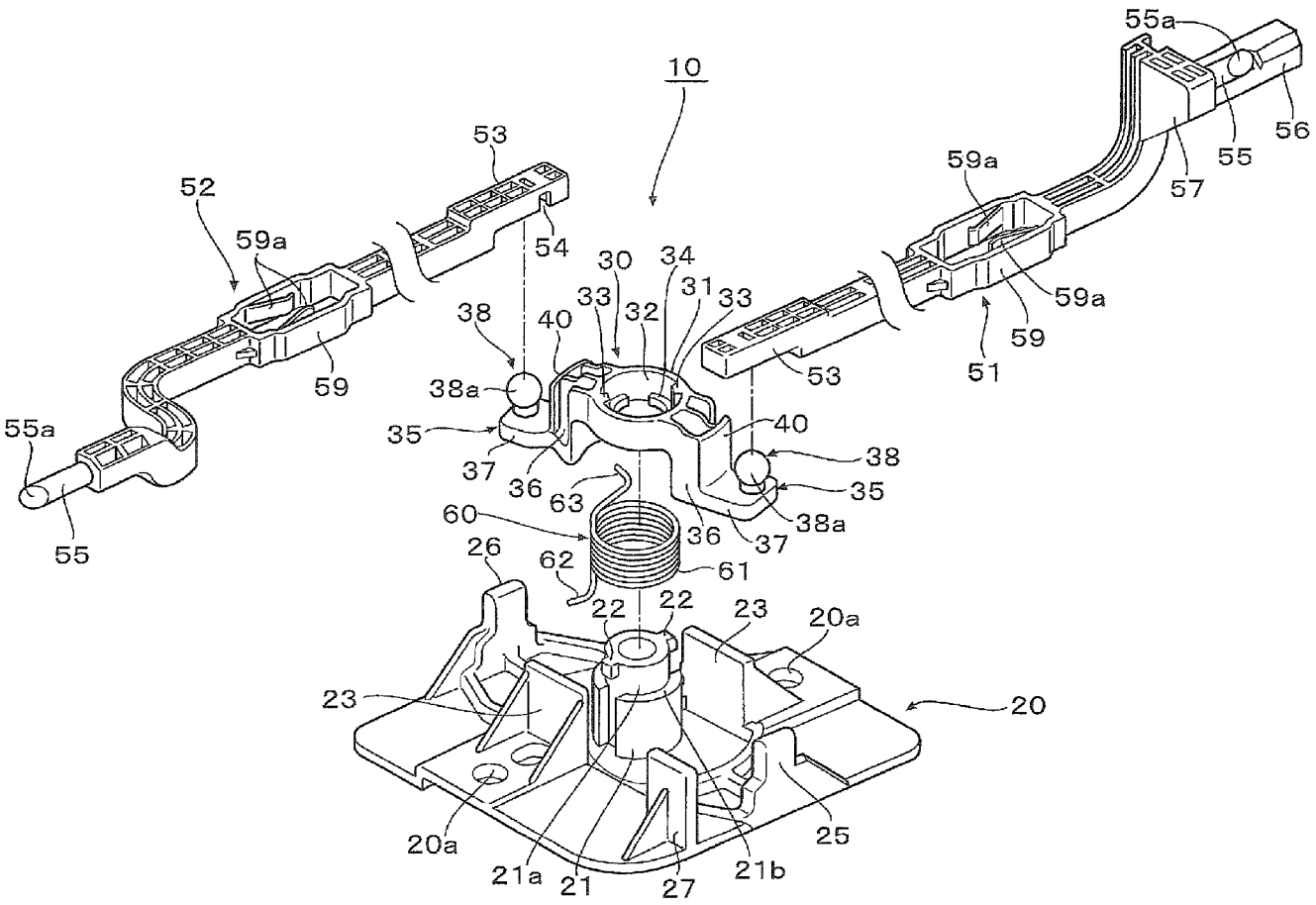
FIG. 1 is an exploded perspective view showing an embodiment of an openable/closable member locking device according to the invention.
Figure 2:
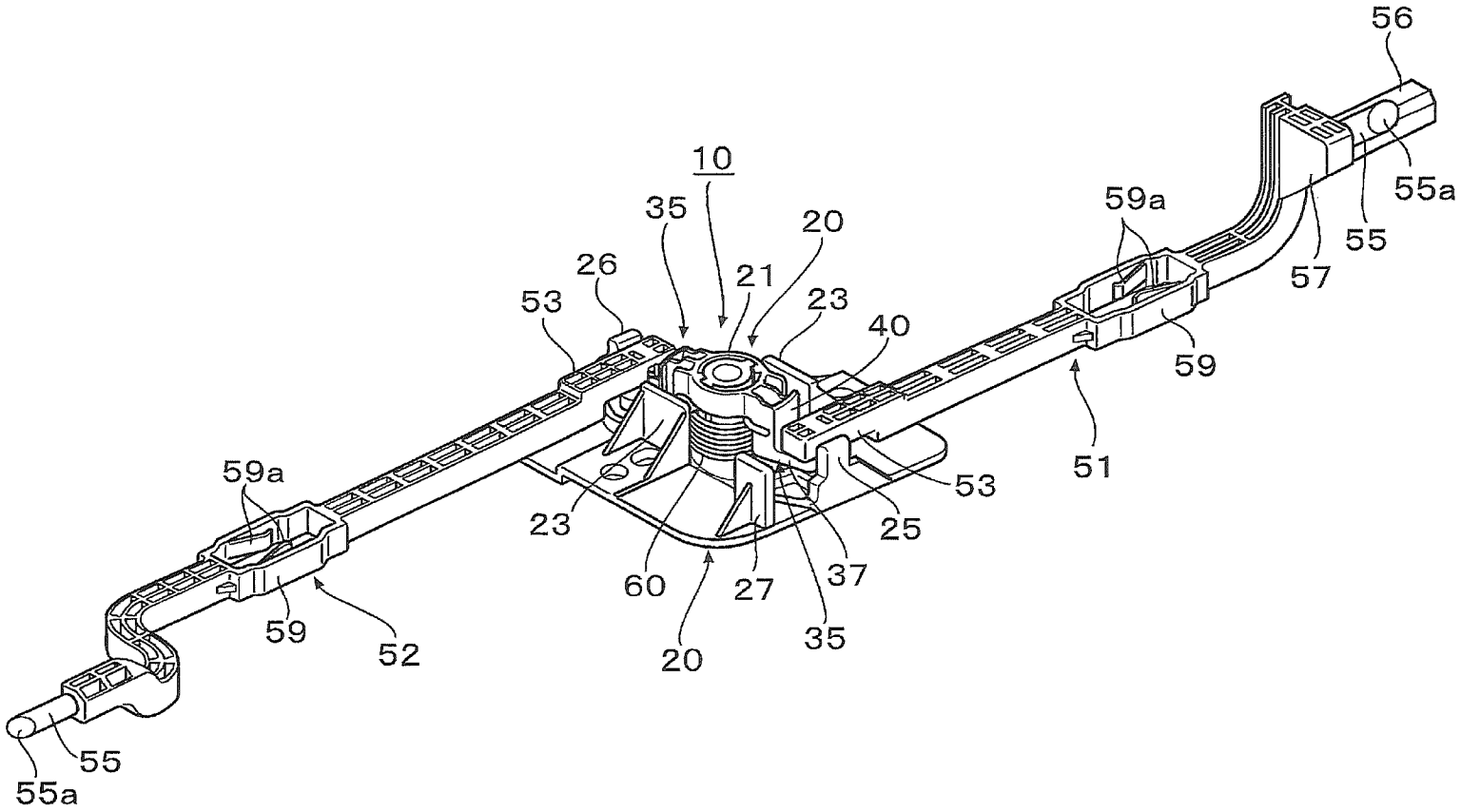
FIG. 2 is a perspective view of the locking device.
Figure 3:
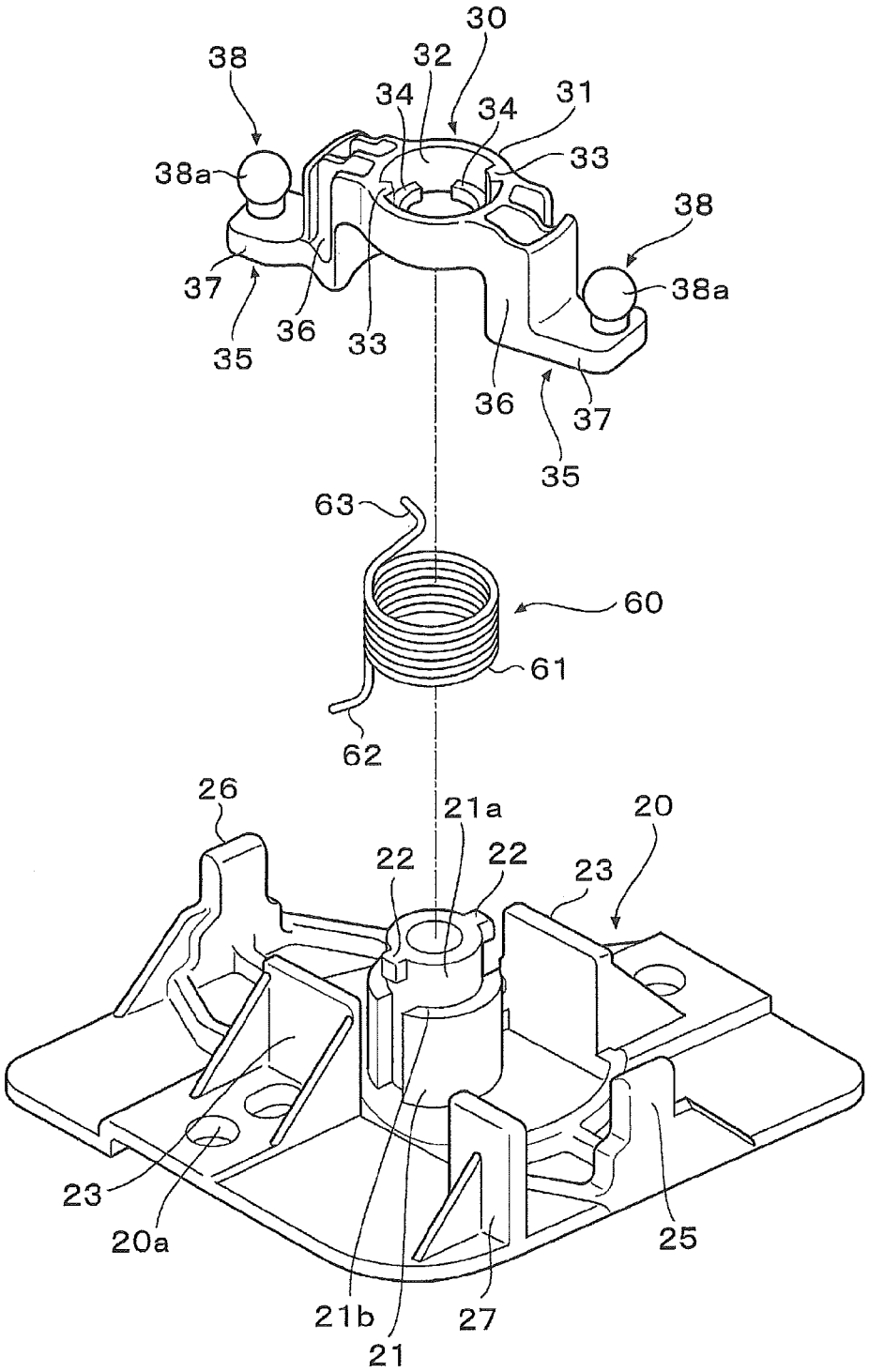
FIG. 3 is an exploded perspective view of a main part of the locking device.

As shown in FIGS. 1 to 3, the locking device 10 of this embodiment includes a mounting base 20, a pivot 21, a rotor 30, a pair of arms 35, 35, a pair of sliding pins 51, 52, a torsion coil spring 60 and a lock release unit. The mounting base 20 is mounted on the back side of the upper wall of the glove box main body 1, and the pivot 21 projects from the mounting base 20. The rotor 30 is mounted rotatably on the mounting base 20 via the pivot 21, and the arms 35, 35 extend radially outwards from the rotor 30. An arc-shaped wall portion 40 is formed on an outer circumference of each arm 35. The sliding pins 51, 52 are connected to the corresponding arms 35, 35 at proximal end portions 53 thereof, so that distal end portions 55 thereof are inserted into and dislocated from the engagement holes 6*a* (refer to FIGS. 9 and 10) provided in the lid 5. The torsion coil spring 60 rotationally urges the rotor 30 in a direction in which the sliding pins 51, 52 are inserted into the corresponding engagement holes 6*a*. The lock release unit causes the sliding pins 51, 52 to move against an urging force of the torsion coil spring 60 so thereby be dislocated from the engagement holes 6*a*.

The mounting base 20 is formed into a rectangular plate with a partial cutout, and the pivot 21 integrally erects from a given position thereon. A distal end portion 21*a* of the pivot 21 is narrowed diametrically relative to a proximal portion thereof via a step portion 21*b*, and projections 22 are provided on opposite positions of an outer circumferential surface of the distal end portion 21*a*. A pair of wall portions 23, 23 erect from an outer circumference of the pivot 21 of the mounting base 20 so as to face each other diametrically obliquely. One 62 of leg portions of the torsion coil spring 60 is locked on one of the wall portions 23, 23.

Figure 7:
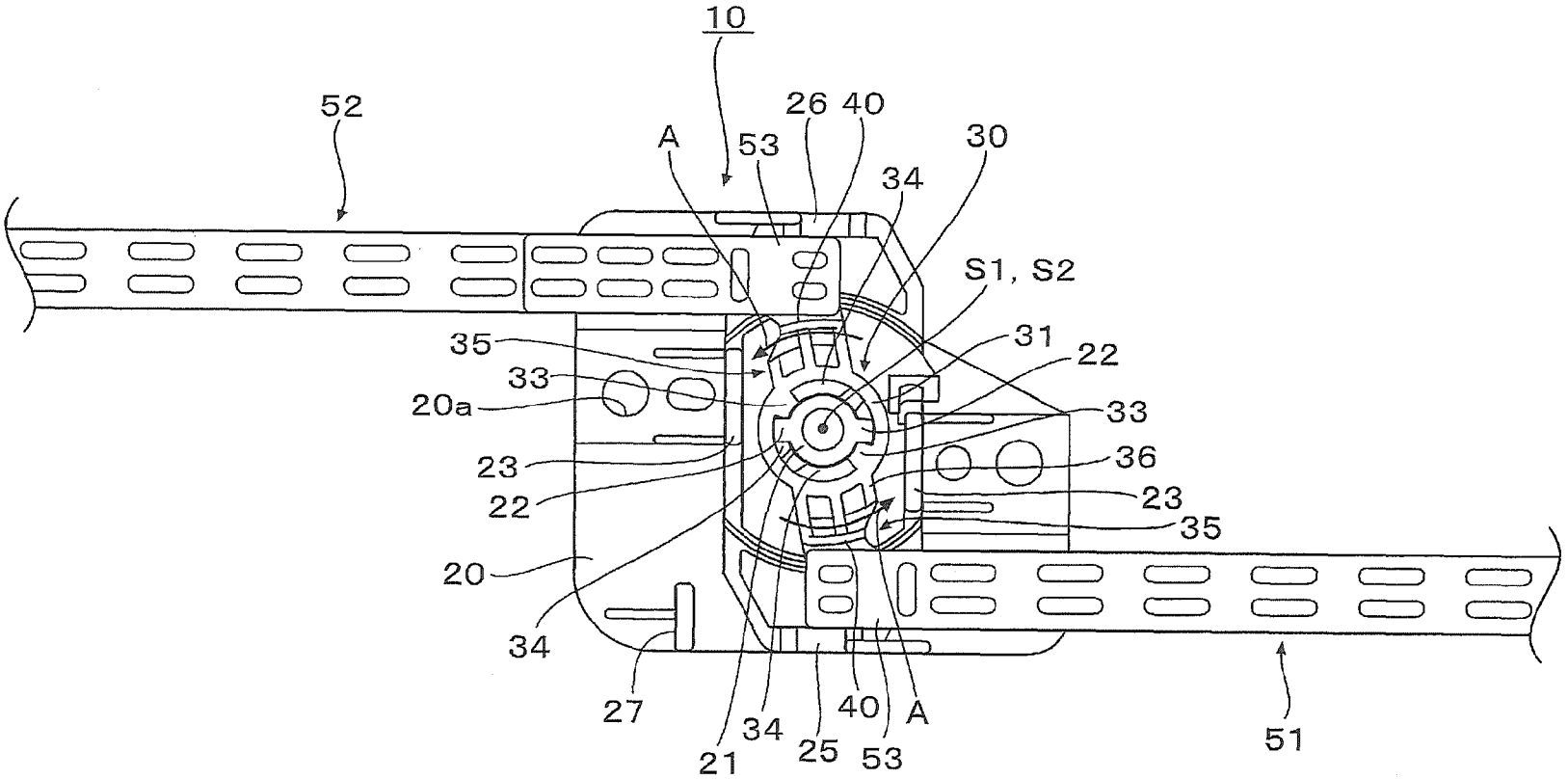
FIG. 7 is an enlarged explanatory diagram showing a state in which the sliding pins of the locking device are pushed out.
Figure 8:
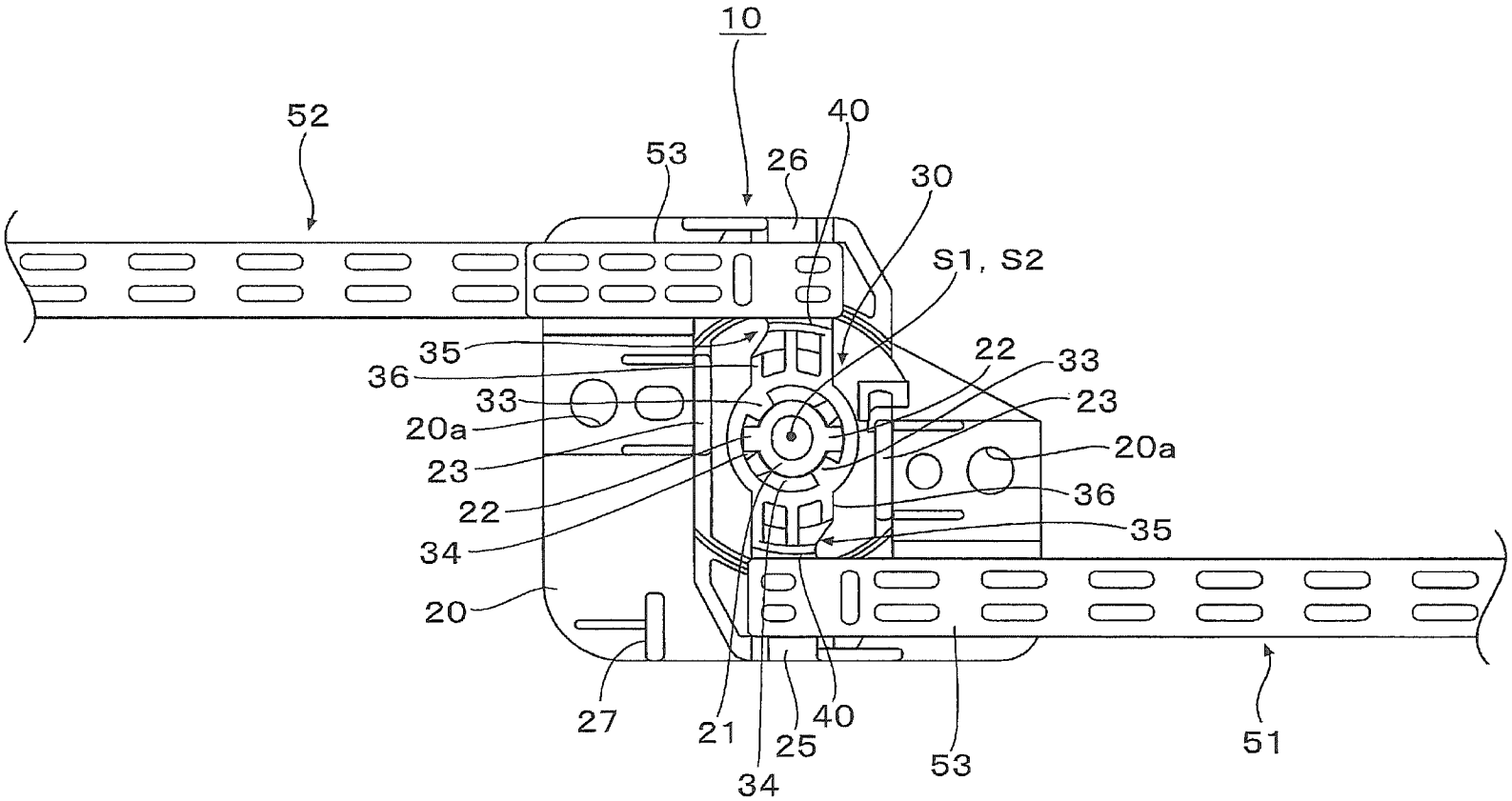

Guide walls 25, 26 erect from the mounting base 20 so as to face the arc-shaped wall portions 40, 40 on the outer circumferences of the arms 35 with spaces defined therebetween. These defined spaces allow the siding pins 51, 52 to be inserted therein. As shown in FIGS. 7, 8, in this embodiment, the guide walls 25, 26 erect from both sides of the mounting base 20 at positions which face obliquely with respect to an axis S1 of the pivot 21. Thus, the guide walls 25, 26 face outer sides of the sliding pins 51, 52. Here, the outer sides of the sliding pins 51, 52 correspond to outer sides of the mounting base 20. A push-in restricting wall 27 also erects from the mounting base 20 at a position which is spaced a given distance away from the guide wall 25. This push-in restricting wall 27 restricts the sliding pin 51 from being pushed in excessively, thereby preventing the dislocation of the rotor 30 from the pivot 21.

The rotor 30, which is supported rotatably on the pivot 21, has a circular rotating portion 31. A shaft hole 32 is formed in the center of the circular rotating portion 31, and the arms 35, 35 extend radially outwards from opposite positions of an outer circumferential surface of the rotating portion 31. A pair of stopper projections 33, 33 project from opposite positions of an inner circumference of the shaft hole 32 along an axial direction of the shaft hole 32. As shown in FIG. 7, when the rotor 30 is rotationally urged by the torsion coil spring 60 whereby the sliding pins 51, 52 are pushed out, the stopper projections 33, 33 abut respectively with the corresponding projections 22, 22 on the pivot 21 to thereby restrict the rotational angle of the rotor 30. Namely, in this embodiment, the stopper projections 33 and the projections 22 make up a "rotation restricting portion" of the invention.

As shown in FIGS. 3 and 7, plural ribs 34 project from the inner circumference of the axial end portion of the shaft hole 32 between the stopper projections 33, 33 along a circumferential direction of the shaft hole 32. Gaps are provided between the plural ribs 34 so as to allow the projections 22 of the pivot 21 to be inserted therethrough. Then, the pivot 21 is inserted into the shaft hole 32 in the rotor 30, and the projections 22, 22 of the pivot 21 are passed through the gaps between the plural ribs 34, whereafter the rotor 30 is rotated in a given direction. As a result, the ribs 34 on the rotor 30 can be held between the projections 22 and the step portion 21*b* of the pivot 21, whereby the rotor 30 is mounted rotatably on the pivot 21 without the dislocation.

The arms 35, 35 have base portions 36, 36 and distal end portions 37, 37. The base portions 36, 36 are suspended along the axial direction of the shaft hole 32 from opposite positions of the outer circumferential surface of the rotating portion 31 so as to define a space therebetween. The defined space is larger than outside diameter of the torsion coil spring 60. The distal end portions 37, 37 extend radially outwards from end portions of the corresponding base portions 36. Connecting members 38 for connection with the sliding pins 51, 52 are provided respectively at extending ends of the distal end portions 37. Distal end portions 38*a* of the connecting members 38 expand into a spherical shape.

As shown in FIGS. 2 and 7, the sliding pins 51, 52 are connected to the respective distal end portions 37 of the arms 35, 35 via the connecting members 38 so as to have no play in a lengthwise direction thereof but have a given play in a direction perpendicular to the lengthwise direction. The sliding pins 51, 52 are disposed point symmetrically in a horizontal left-to-right direction with respect to the shaft hole 32 in the rotor 30 via the connecting members 38.

The arc-shaped wall portion 40 is formed on an outer circumference of the base portion 36 of each arm 35, and has an arc shape of a given radius about a center S2 (refer to FIG. 7) of the shaft hole 32 in the rotor 30. As shown in FIGS. 7, 8, these arc-shaped wall portions 40, 40 are disposed close to inner surfaces of the sliding pins 51, 52 which face the pivot 21. These arc-shaped wall portions 40, 40 make up a guide portion together with the guide walls 25, 26 which are disposed close to the outer surfaces of the sliding pins 51, 52, so that the sliding pins 51, 52 slide straight along the lengthwise direction thereof. Namely, in this embodiment, the arc-shaped wall portions 40, 40 and the guide walls 25, 26 make up a "guide portion" of the invention.

Figure 4:
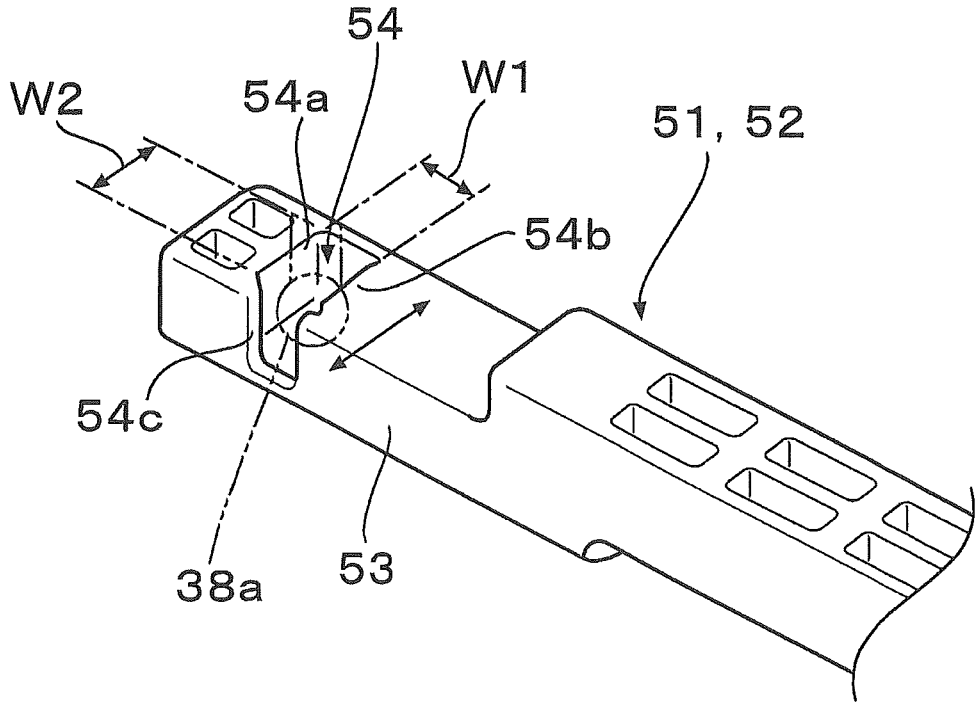
FIG. 4 is an exploded perspective view of a main part of a sliding pin of the locking device.
Figure 5:
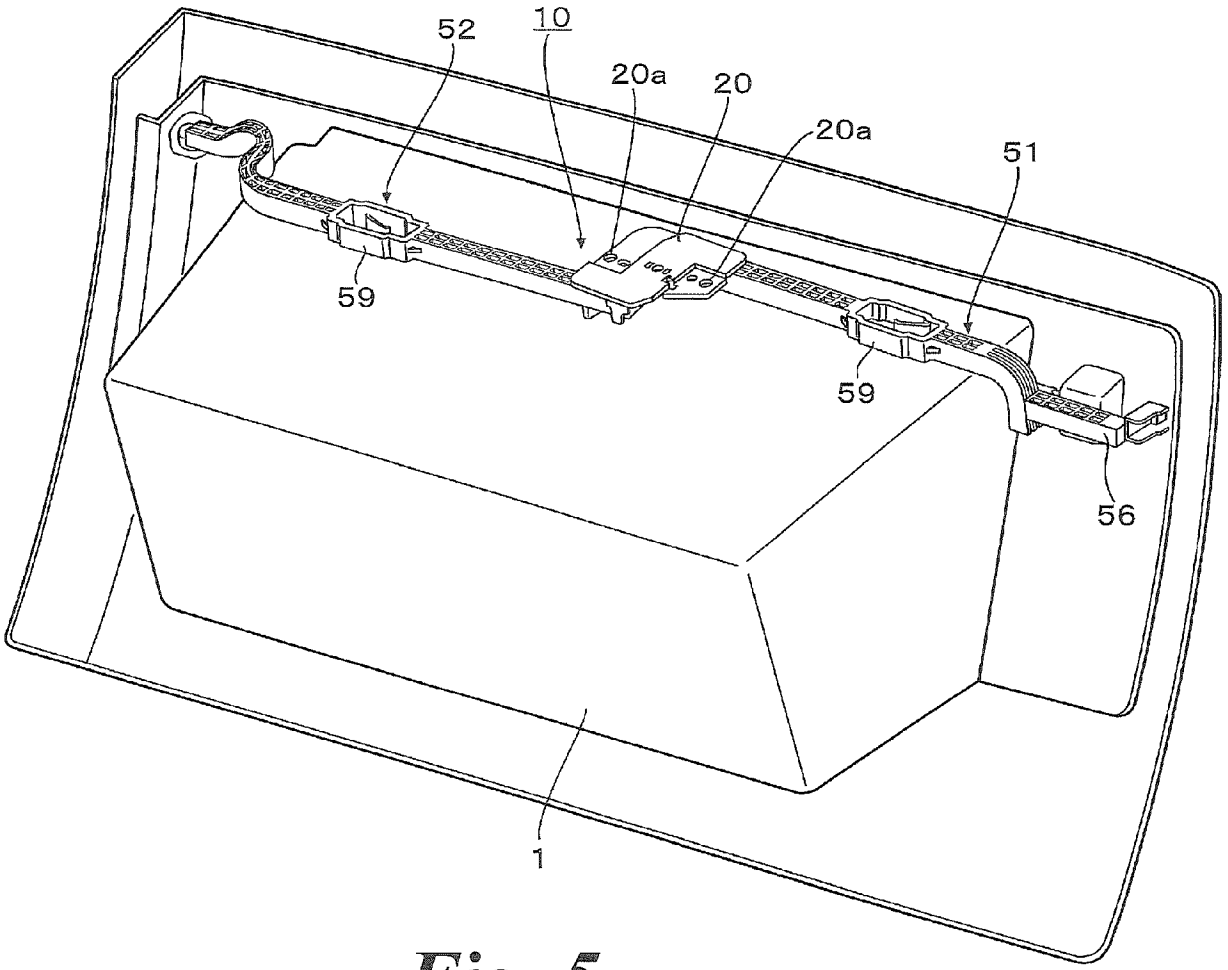
FIG. 5 is a perspective view showing a state in which the locking device is mounted on a platform member.

The sliding pins 51, 52, which are connected to the arms 35, 35 via the corresponding connecting members 38, are formed into an angular rod-like shape which extends generally straight. As shown in FIG. 4, a frame-shaped connecting recess portion 54 is formed in the proximal end portion 53 of each of the sliding pins 51, 52 so as to receive the spherical distal end portion 38*a* of the connecting member 38. In this connecting recess portion 54, a rear surface side (a mounting base 20 side) and one lateral side of the sliding pin 51, 52 are opened, and a projection 54*b* is formed on an inner circumference of the rear surface side opening 54*a*. The lateral side opening 54*c* is formed smaller than an outside diameter of the distal end portion 38*a* of the connecting member 38. Thus, the sliding pin 51, 52 can be connected to the distal end portion 37 of the arm 35 without the dislocation by fitting the spherical distal end portion 38*a* into the connecting recess portion 54.

A width W1 of the connecting recess portion 54 which is defined along the lengthwise direction of the sliding pin 51, 52 is set so as to match the outside diameter of the distal end portion 38*a* of the connecting member 38. A width W2 of the connecting recess portion 54 which is defined along the direction perpendicular to the lengthwise direction of the sliding pin 51, 52 is set so as to be slightly larger than the outside diameter of the distal end portion 38*a* (refer to FIG. 4). Consequently, the proximal end portion 53 of the sliding pin 51, 52 is connected to the distal end portion 37 of each arm 35 via the connecting member 38 so as to have no play in the lengthwise direction of the sliding pin 51, 52 but have the given play in the direction perpendicular to the lengthwise direction (refer to an arrow in FIG. 4).

Figure 9:
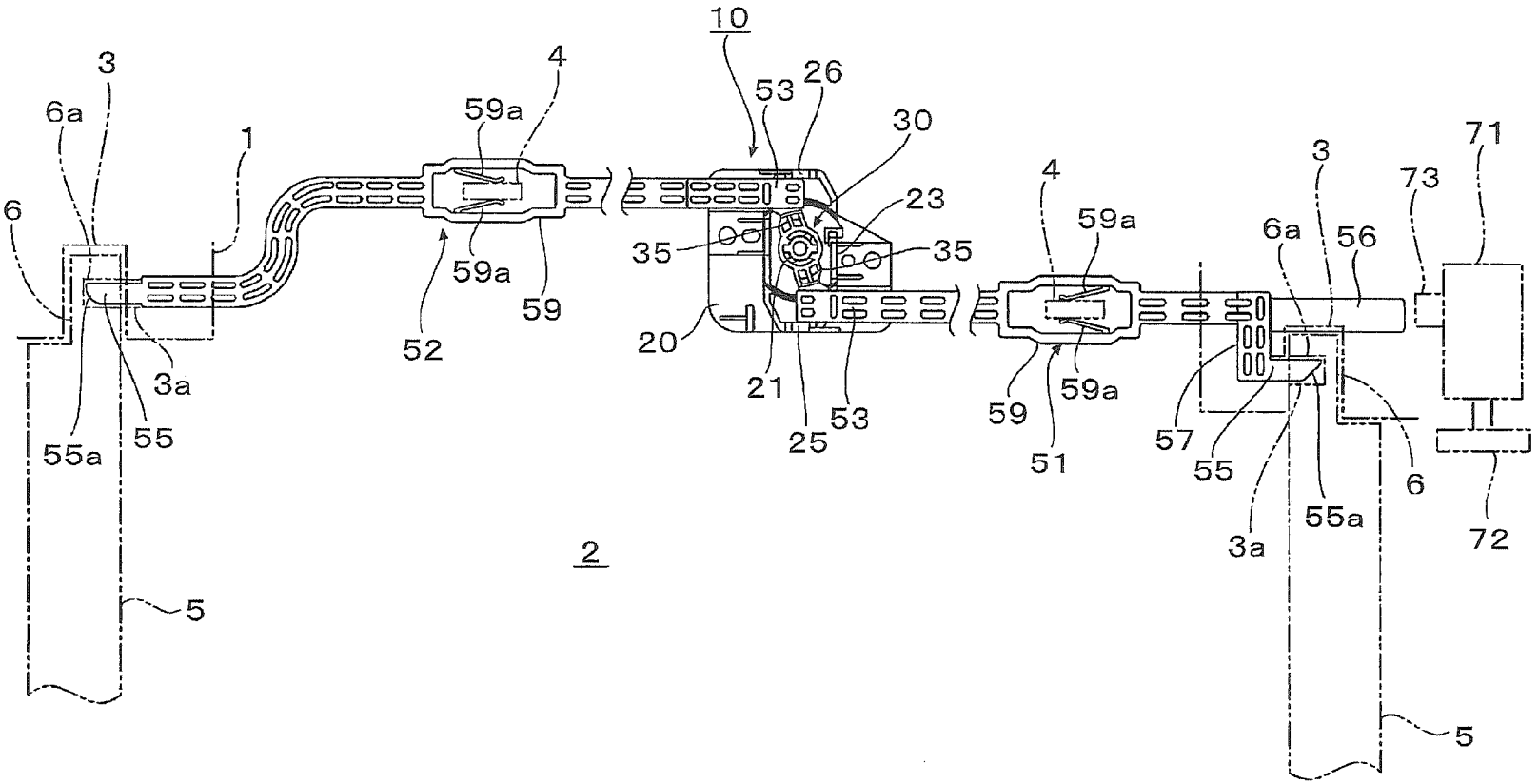
FIG. 9 is an explanatory diagram showing a state in which the sliding pins of the locking device are pushed out to be in engagement with engagement holes.

An axial distal region of the sliding pin 51 is bent correspondingly with the shape of the glove box main body 1, and has a rod-shaped lock release receiving portion 56 and a distal end portion 55. The lock release receiving portion 56 extends coaxially with an axial proximal region of the sliding pin 51, and the distal end portion 55 extends parallel to the lock release receiving portion 56 via a wall portion 57 (refer to FIGS. 9 and 10). An axial distal region of the sliding pin 52 is also bent correspondingly with the shape of the glove box main body 1, and has a distal end portion 55 which extends parallel to an axial proximal region of the sliding pin 52. A tapered surface 55*a* is formed on one side surface of each distal end portion 55. As shown in FIGS. 6 and 9, each distal end portion 55 is inserted slidably into the through hole 3*a* in the recess portion 3 of the glove box main body 1 so as to be inserted into and dislocated from the engagement hole 6*a* in the lid 5.

Figure 10:
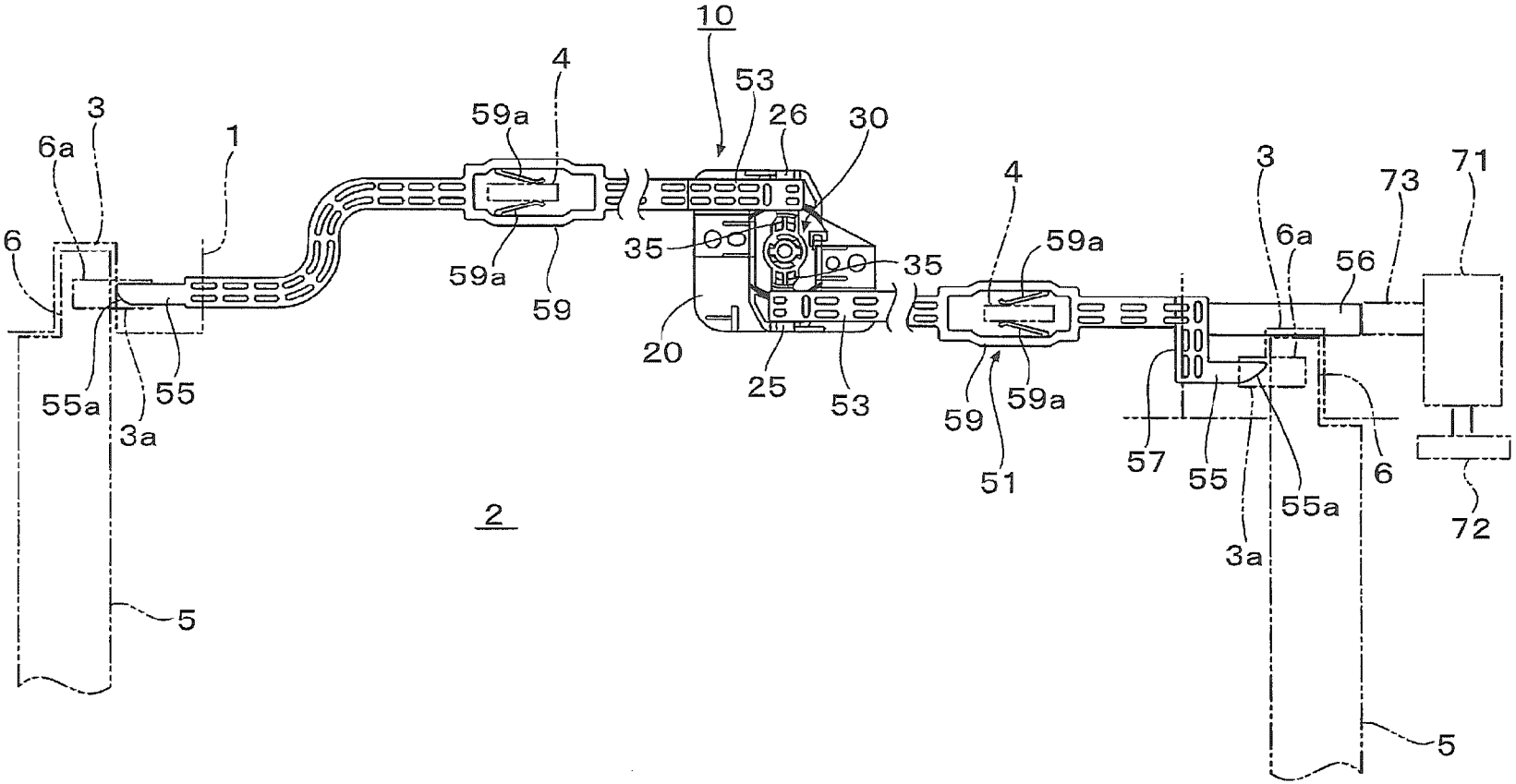
FIG. 10 is an explanatory diagram showing a state in which the sliding pins of the locking device are drawn in whereby the engagement of the sliding pins with the engagement holes is released.

As shown in FIG. 1, frame-shaped guides 59 are provided between the proximal end portions 53 and the distal end portions 55 of the sliding pins 51, 52, and each frame-shaped guide 59 has a frame-like shape. A pair of elastic pieces 59*a*, 59*a* project from an inner circumference of each frame-shaped guide 59 into a "V" shape oriented towards the corresponding proximal end portion 53. As shown in FIGS. 9 and 10, the guide rib 4 erected from the back side of the upper wall of the glove box main body 1 are disposed between the elastic pieces 59*a*, 59*a*, whereby the guide rib 4 is elastically held by the elastic pieces 59*a*, 59*a* therebetween.

The torsion coil spring 60 is placed over the pivot 21, and has a cylindrical coil portion 61 and the leg portions 62, 63. The coil portion 61 is disposed in an inner circumferential space defined by the arms 35, 35. The leg portion 62 extending from one end of the coil portion 61 is locked on the wall portion 23 of the mounting base 20, while the leg portion 63 extending from the other end of the coil portion 61 is locked on the outer circumference of the base portion 36 of the arm 35. The rotor 30 is rotationally urged in a given direction by this torsion coil spring 60 (refer to an arrow A in FIG. 7), so that the respective distal end portions 55 of the sliding pins 51, 52 are normally urged in directions in which the distal end portions 55 are inserted in the corresponding engagement holes 6*a* in the lid 5.

The torsion coil spring 60 makes up a "return spring" of the invention. There is no specific limitation on the type of a return spring used, provided that a return spring used rotationally urges the rotor directly or indirectly in the directions in which the sliding pins are inserted into the corresponding engagement holes. For example, a coiled tensile spring may be used as a return spring. In this case, one end of the coiled tensile spring may be hooked on a pin provided on the mounting base 20, and the other end thereof may be hooked on the rotor 30 so as to rotationally urge the rotor 30 directly. Alternatively, the one end of the tensile spring may be hooked on the pin on the mounting base 20, and the other end thereof may be hooked on either of the sliding pins 51, 52 so as to rotationally urge the rotor 30 indirectly.

In this embodiment, as shown in FIG. 6, the lock release unit, which draws the respective distal end portions 55 of the sliding pins 51, 52 out of the corresponding engagement holes 6*a* in the lid 5, is disposed adjacent to one of the recess portions 3 in the glove box main body 1. As shown in FIGS. 9 and 10, this lock release unit has a case 71, a push button 72 which is disposed slidably on a front surface of the case 71, and a lock release rod 73 which projects from a side surface of the case 71 when the push button 72 is pushed in. The lock release unit is mounted on the glove box main body 1 so that the lock release rod 73 faces the lock release receiving portion 56 of the sliding pin 51. Thus, when the push button 72 is pushed in, the lock release rod 73 projects from the side surface of the case 71 to thereby press against the lock release receiving portion 56 against the urging force of the torsion coil spring 60, whereby the distal end portion 55 of the sliding pin 51 is drawn out of the corresponding engagement hole 6*a*. The distal end portion 55 of the other sliding pin 52 is also drawn out of the corresponding engagement hole 6*a* via the rotor 30 (refer to FIG. 10).

Next, the function and advantage of the above-described openable/closable member locking device will be described.

As shown in FIGS. 1 and 3, the coil portion 61 of the torsion coil spring 60 is placed over the pivot 21, and the one leg portion 62 is locked on the wall portion 23 of the mounting base 20, while the other leg portion 63 is hooked on the outer circumference of the rotating portion 31 of the rotor 30. In this state, the pivot 21 is inserted into the shaft hole 32 in the rotor 30 such that the projections 22, 22 of the pivot 21 passed through the gaps defined between the plural ribs 34, whereafter the rotor 30 is rotated in the given direction, whereby the rotor 30 is mounted rotatably on the pivot 21 without the dislocation. The outer circumference of the coil portion 61 of the torsion coil spring 60 is partially covered by the base portions 36 of the arms 35, 35.

As this occurs, although the rotor 30 is rotationally urged in the direction indicated by the arrow A in FIG. 7 by the urging force of the torsion coil spring 60, since the stopper projections 33, 33 of the rotor 30 abut respectively with the projections 22, 22 of the pivot 21, the rotation of the rotor 30 is restricted. Since the rotational angle of the rotor 30 in the urging direction of the torsion coil spring 60 is restricted by the rotation restricting portion provided between the pivot 21 erected from the mounting base 20 and the rotor 30, striking noise produced when the rotor 30 is stopped can be suppressed, compared with a case of restricting the rotation of the rotor 30 by stopping the sliding pins.

As described above, the rotor 30 is mounted on the mounting base 20 via the pivot 21, and the respective proximal end portions 53 of the sliding pins 51, 52 are inserted between the respective arc-shaped wall portions 40, 40 of the arms 35 and the guide walls 25, 26 erected from the mounting base 20. Then, the respective connecting members 38 of the arms 35 are fitted into the corresponding connecting recess portions 54, whereby the respective proximal end portions 53 of the sliding pins 51, 52 are connected respectively to the corresponding distal end portions 37 of the arms 35. Thus, the sliding pins 51, 52 are disposed point symmetrically with respect to the shaft hole 32 in the rotor 30 (refer to FIGS. 2 and 7).

In that state, the mounting base 20 is disposed while orienting the pivot 21 projecting surface thereof towards the back side of the upper wall of the glove box main body 1, so as to hold the rotor 30 and the sliding pins 51, 52 between the mounting base 20 and the back side of the upper wall of the glove box main body 1, and the respective distal end portions 55 of the sliding pins 51, 52 are inserted into the corresponding through holes 3*a* in the glove box main body 1. The guide ribs 4 on the glove box main body 1 are respectively inserted into the elastic pieces 59*a*, 59*a* of the frame-shaped guides 59 of the sliding pins 51, 52 (refer to FIGS. 9, 10), and the mounting base 20 is fixed to the glove box main body 1 with screws through circumferentially-arranged mounting holes 20*a*, whereby the locking device 10 can be mounted on the glove box main body 1.

In the locking device 10, in a state in which the sliding pins 51, 52 are connected to the arms 35, 35 extending from the rotor, the rotor 30 and the sliding pins 51, 52 are held between the mounting base 20 and the glove box main body 1. Thus, the dislocation of the sliding pins 51, 52 from the corresponding arms 35 can be prevented.

In this locking device 10, since the arms 35, 35 and the sliding pins 51, 52 can be fitted together as an assembly by connecting the proximal end portions 53 of the sliding pins 51, 52 to the distal end portions 37 of the arms 35, 35 in advance, the mountability of the locking device 10 on the platform member can be enhanced.

When the locking device 10 is mounted on the glove box main body (platform member) 1, the sliding pins 51, 52 are rotationally urged in the direction indicated by the arrow A in FIG. 7 by the torsion coil spring 60, so that the distal end portions 55 thereof are normally inserted in the engagement holes 6*a* in the lid 5.

When the lid 5 is pushed in so as to close the cavity portion 2 in the glove box main body 1, the projecting portions 6 of the lid 5 are inserted into the recess portions 3 in the glove box main body 1, whereby the tapered surface 55*a* of the respective distal end portions 55 of the sliding pins 51, 52 are pressed against by the projecting portions 6, and the respective distal end portions 55 thereof slide inwards against the urging force of the torsion coil spring 60. Then, when the distal end portions 55 reach the corresponding engagement holes 6*a*, the rotor 30 is rotationally urged by the urging force of the torsion coil spring 60, and the sliding pins 51, 52 slide outwards as the rotor 30 so that the distal end portions 55 are brought into engagement with the corresponding engagement holes 6*a*, 6*a* in the lid 5, whereby the lid 5 can be locked in a state in which the cavity portion 2 in the glove box main body 1 is closed by the lid 5 (refer to FIG. 9).

In this locked state, when the push button 72 of the lock release unit is pushed in, the lock release rod 73 projects from the side surface of the case 71 to press the lock release receiving portion 56 of the sliding pin 51, whereby the sliding pin 51 slides inwards against the urging force of the torsion coil spring 60, and in synchronism with this, the rotor 30 rotates against the urging force applied thereto to thereby cause the sliding pin 52 to slide inwards. Thus, the respective distal end portions 55 of the sliding pins 51, 52 are dislocated from the corresponding engagement holes 6*a* in the lid 5, whereby the cavity portion 2 in the glove box main body 1 is opened.

As described above, when the sliding pins 51, 52 slide in connection with opening/closing of the lid 5, the arms 35, 35 move arcwise as the rotor 30 rotates. In the conventional construction, the proximal end portions 53 of the sliding pins 51, 52 also move arcwise, whereby the sliding pins 51, 52 are inclined.

However, in the invention, the respective proximal end portions 53 of the sliding pins 51, 52 are connected to the corresponding distal end portions 37 of the arms 35, 35 so as to have no play in the lengthwise direction of the sliding pins 51, 52 but have the given play in the direction perpendicular to the lengthwise direction (refer to FIG. 4). The sliding pins 51, 52 are held by the arc-shaped wall portions 40 and the guide walls 25, 26 therebetween to thereby be restricted from moving in the radial direction of the rotor 30. Thus, the sliding pins 51, 52 are allowed to slide straight. Because of this, it is possible to prevent an increase in sliding resistance or a generation of abnormal noise which would otherwise be caused as a result of an inclination of the sliding pins 51, 52, bringing the distal end portions 55 thereof into sliding contact with inner circumferences of the engagement holes 6*a* in the lid 5.

Even though the rotor 30 rotates, the arc-shaped wall portions 40 on the outer circumference of the arms 35 do not interfere with the sliding pins 51, 52 but can guide the sliding pins 51, 52 while maintaining the distance with the guide walls 25, 26 constant, whereby the sliding operation of the sliding pins 51, 52 can be performed more smoothly.

In this embodiment, the frame-shaped guides 59 are provided on axial intermediate regions of the sliding pins 51, 52, and the guide ribs 4 provided on the glove box main body 1 are elastically held by the elastic pieces 59*a*, 59*a* provided in the frame-shaped guides 59. Therefore, the sliding operation of the sliding pins 51, 52 is also guided by these elastic pieces 59*a*, 59*a*, whereby the sliding pins 51, 52 are allowed to slide straight in a more ensured fashion.

Figure 11A:
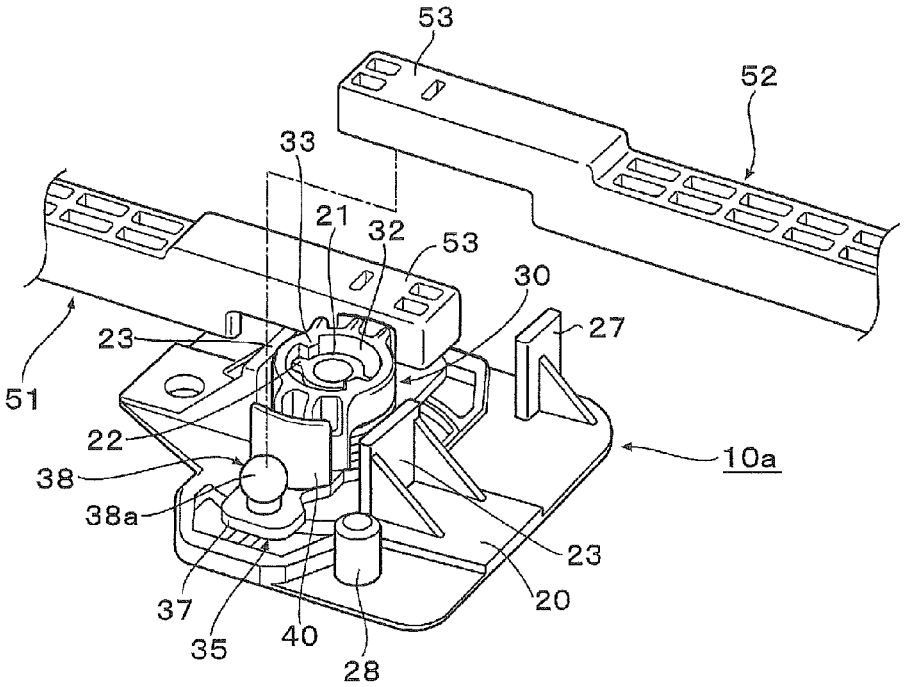
FIG. 11 shows another embodiment of an openable/closable member locking device according to the invention, FIG. 11(*a*) being an exploded perspective of the locking device, FIG. 11(*b*) being a plan view thereof.
Figure 11B:
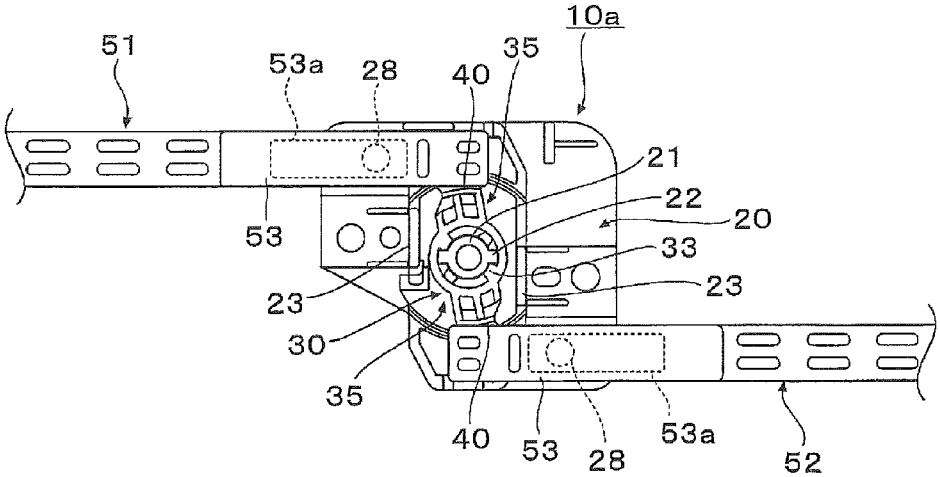
Figure 12A:
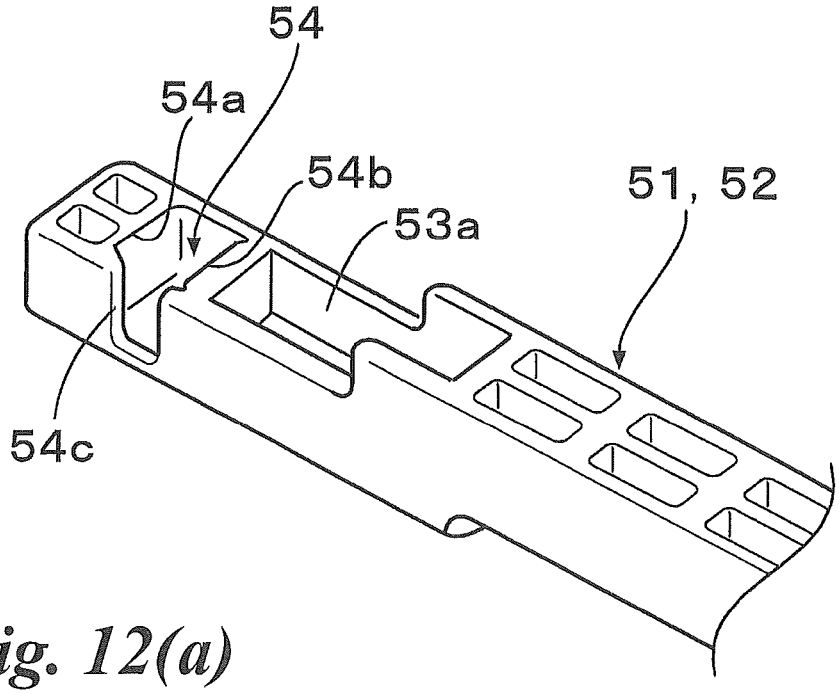
FIG. 12 shows a sliding pin of the locking device, FIG. 12(*a*) being an enlarged perspective view of a main part thereof, FIG. 12(*b*) being an enlarged perspective view of the main part as seen in a different direction from the one in which FIG. 12(*a*) is seen.
Figure 12B:
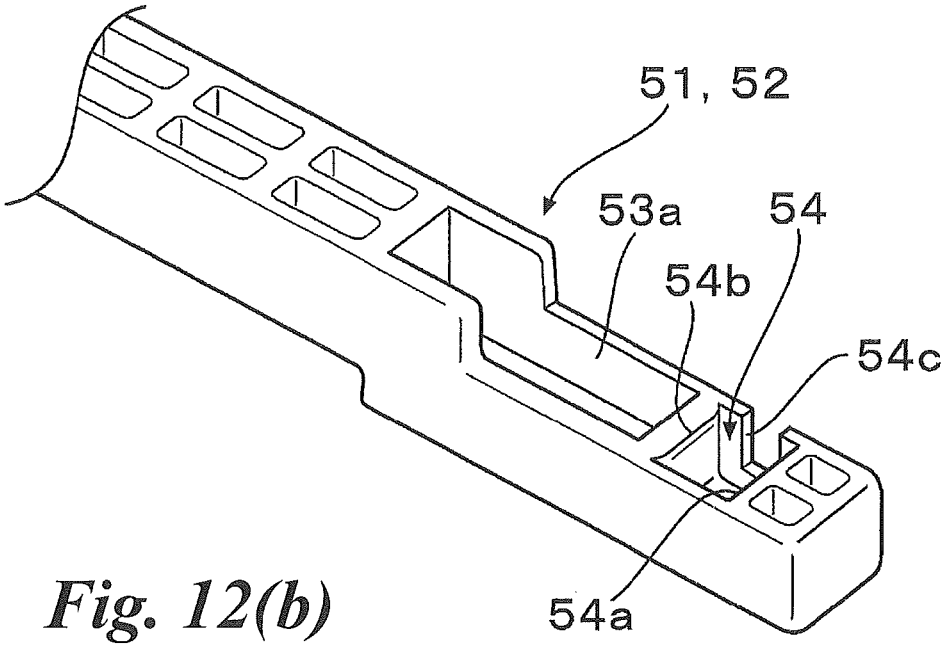

FIGS. 11 and 12 show another embodiment of an openable/closable member locking device according to the invention. Like reference numerals will be given to substantially like portions to those of the above-described embodiment, and the description thereof will be omitted here.

An openable/closable member locking device (locking device) 10*a* of this embodiment differs from the above-described embodiment in the construction of a guide portion which allows a pair guide pins 51, 52 to slide straight along a lengthwise direction thereof.

Namely, cylindrical guide projections 28 erect from a mounting base 20 of this locking device 10*a* so as to be aligned with portions of the sliding pins 51, 52 which lie slightly further distal towards than proximal end portions 53 thereof (refer to FIG. 11(*a*)). On the other hand, in the sliding pins 51, 52, guide grooves 53*a*, into which the guide projections 28 are inserted slidably, are formed adjacent to the proximal end portions 53 along the lengthwise direction (refer to FIGS. 12(*a*), 12(*b*)).

As shown in FIG. 11(*b*), when the proximal end portions 53 of the sliding pins 51, 52 are connected to corresponding distal end portions 37 of arms 35, 35 via connecting members 38, the guide projections 28 are inserted into the guide grooves 53*a*, whereby the sliding pins 51, 52 are allowed to slide straight along the lengthwise direction by the guide projections 28 and the guide grooves 53*a*. In this embodiment, the guide projections 28 and the guide grooves 53*a* make up the "guide portion" of the invention.

Figure 13A:
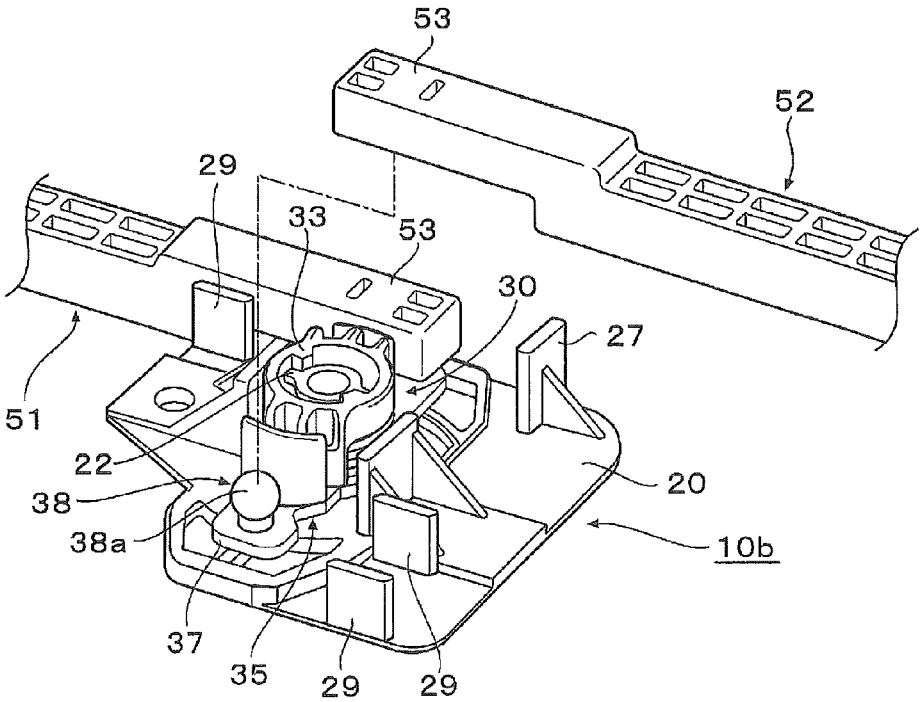
FIG. 13 shows a still another embodiment of an openable/closable member locking device according to the invention, FIG. 13(*a*) being an exploded perspective of the locking device, FIG. 13(*b*) being a plan view thereof.
Figure 13B:
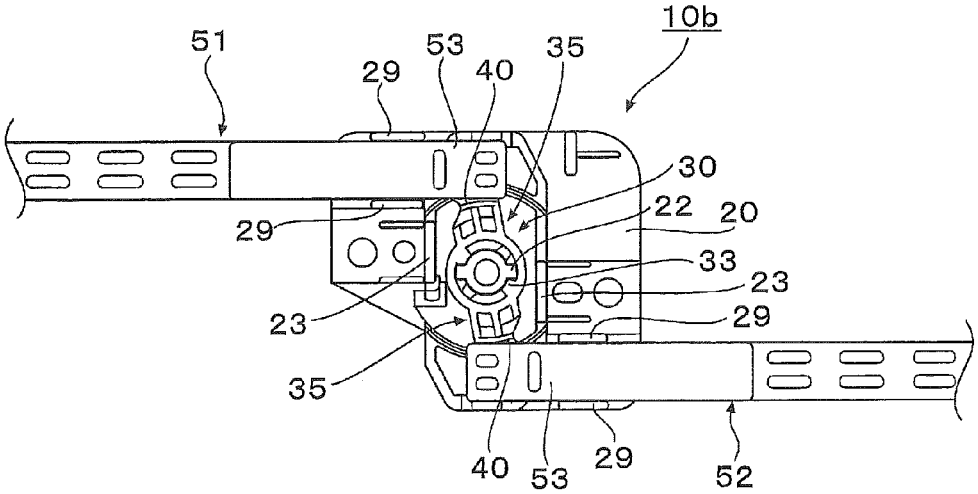

FIG. 13 shows a still another embodiment of an openable/closable member locking device according to the invention. Like reference numerals will be given to substantially like portions to those of the above-described embodiment, and the description thereof will be omitted here.

An openable/closable member locking device (locking device) 10*b* of this embodiment differs from the above-described embodiment in the construction of a guide portion which allow a pair guide pins 51, 52 to slide straight along a lengthwise direction thereof.

Namely, pairs of guide walls 29, 29 erect from a mounting base 20 of the locking device 10*b* at positions spaced a given distance away from distal end portions 37 of a pair of arms 35, 35. Each pair of guide walls 29, 29 define a space therebetween so as to allow the sliding pin 51, 52 to be inserted therein.

As shown in FIG. 13(*b*), when proximal end portions 53 of the sliding pins 51, 52 are connected to the corresponding distal end portions 37 of the arms 35, 35, the sliding pins 51, 52 are held between the corresponding pairs of guide walls 29, 29, whereby the sliding pins 51, 52 are allowed to slide straight along the lengthwise direction thereof. In this embodiment, the pairs of guide walls 29, 29 provided on the mounting base 20 make up the "guide portion" of the invention.

In the above-described embodiments, the locking device is mounted on the glove box main body 1 as the platform member. However, the locking device can also be mounted on the lid 5 as the openable/closable member. There is imposed no specific limitation on the locking device mounting construction. In the constructions of the above-described embodiments, the lid 5 is mounted openably/closably to the cavity portion in the box-shaped glove box main body 1. However, the invention may be applied to a construction in which a box-shaped glove box is mounted openably/closably to a cavity portion in an instrument panel, or a construction in which a lid is mounted openably/closably to a cavity portion in an instrument panel (in this case, the instrument panel makes up the "platform member" of the invention, and the glove box or the lid makes up the "openable/closable member" of the invention). The invention can widely be applied to any platform member having a cavity portion. Although the push-button-type lock release unit in which the siding pin 51 is pushed in is adopted as the lock release unit, there is imposed no specific limitation on the type of the lock release unit. It is possible to use a lever-type unit which causes either of sliding pins 51, 52 to slide, a knob-rotating-type unit which directly causes a rotor 30 to rotate, or an knob-manipulating-type unit which causes a rotor 30 to rotate through pushing in or pulling out manipulation.

DESCRIPTION OF REFERENCE NUMERALS 2 cavity portion; 10, 10*a*, 10*b* locking device; 20 mounting base; 21 pivot; 25, 26, 29 guide walls; 28 guide projection; 30 rotor; 35 arm; 40 arc-shaped wall portion; 51, 52 sliding pin; 53 proximal end portion; 55 distal end portion; 60 torsion coil spring.

The invention claimed is:

1. A locking device for an openable/closable member to be mounted openably/closably to a cavity portion in a platform member, the locking device comprising:
   - a mounting base which is mounted on one of the platform member and the openable/closable member;
   - a pivot which projects from the mounting base;
   - a rotor which is mounted rotatably on the mounting base via the pivot, the rotor integrally including a pair of arms which extend radially outwards from the rotor having distal end portions;
   - a pair of sliding pins which includes:
     - proximal end portions connected to the distal end portions of the corresponding arms; and
     - distal end portions provided so as to be inserted into and dislocated from engagement holes provided on the other of the platform member and the openable/closable member;
   - a return spring which rotationally urges the rotor in a direction in which the sliding pins are inserted into the engagement holes; and
   - a lock release unit which moves the rotor or the sliding pins against an urging force of the return spring so as to draw the sliding pins out of the engagement holes, wherein there is provided a guide portion which causes the sliding pins to slide straight along the lengthwise direction, wherein the pair of arms further include connecting members disposed at each of the distal end portions of the pair of arms, wherein end portions of the connecting members expand into a spherical shape, wherein the proximal end portions of the pair of sliding pins include a recess portion, wherein a width of the recess portion in the lengthwise direction of the sliding pins is substantially equal to a diameter of the spherical shape of the connecting member so as to have no play in the lengthwise direction of the sliding pins, and wherein a width of the recess portion in a direction perpendicular to the lengthwise direction of the sliding pins is greater than the diameter of the spherical shape of the connecting member so as to have a given play in the direction perpendicular to the lengthwise direction.

2. The locking device of claim 1, wherein the mounting base is mounted such that the pivot projecting surface thereof is faced towards the one of the platform member and the openable/closable member in a state in which the rotor and the sliding pins are held between the mounting base and the one of the platform member and the openable/closable member.

3. The locking device of claim 1, wherein a rotation restricting portion is provided on the mounting base and the rotor so as to restrict a rotational angle of the rotor in the urging direction of the return spring.

4. The locking device of claim 1, wherein a distal end portion of the pivot is narrowed diametrically relative to a proximal end portion of the pivot, and wherein the pivot includes projections provided at opposite positions of an outer circumferential surface of the distal end portion.

5. The locking device of claim 4, wherein the rotor includes a shaft hole for mounting to the pivot, and wherein a pair of stopper projections projects from opposite positions of an inner circumference of the shaft hole along an axial direction of the shaft hole, the pair of stopper projections abuts respectively with corresponding projections of the pivot to thereby restrict a rotational angle of the rotor.

6. The locking device of claim 1, wherein the mounting base includes a pair of wall portions erected from an outer circumference of the pivot of the mounting base so as to face each other diametrically obliquely, and wherein the return spring includes a pair of leg portions which lock on the pair of wall portions.

7. A locking device for an openable/closable member to be mounted openably/closably to a cavity portion in a platform member, the locking device comprising:

a mounting base which is mounted on one of the platform member and the openable/closable member;

a pivot which projects from the mounting base;

a rotor which includes:

a rotating portion having a shaft hole through which the pivot is inserted to thereby rotatably mount the rotor on the mounting base; and a pair of arms extending radially outwards from opposite positions on an outer circumference of the rotating portion, each of the pair of arms including:

a base portion extending from the outer circumference of the rotating portion along an axial direction of the shaft hole; and a distal end portion extending radially outwards from the base portion, a pair of sliding pins which includes:

proximal end portions connected to the distal end portions of the corresponding arms; and distal end portions provided so as to be inserted into and dislocated from engagement holes provided on the other of the platform member and the openably/closably member;

a return spring which rotationally urges the rotor in a direction in which the sliding pins are inserted into engagement holes; and a lock release unit which moves the rotor or the sliding pins against an urging force of the return spring so as to draw the sliding pins out of the engagement holes, wherein there is provided a guide portion which causes the sliding pins to slide straight along a lengthwise direction, and wherein the guide portion includes:

an arc-shaped wall portion which is formed on an outer circumference of each of the base portions of the pair of arms, which protrudes radially outwards more than the outer circumference of the rotating portion; and a guide wall which erects from the mounting base so as to face the arc-shaped wall portion with a space defined therebetween, the defined space allowing the sliding pin to be inserted therein.

8. The locking device of claim 7, wherein the return spring further includes:

a cylindrical coil portion placed over the pivot and disposed between inner circumferences of the arms;

one leg portion extending from one end of the coil portion to be locked on the mounting base; and an other leg portion extending from the other end of the coil portion to be locked on the outer circumference of the base portion of the arm.

9. The locking device of claim 7, wherein the pair of arms includes connecting members disposed at each of the distal end portions of the pair of arms.

10. The locking device of claim 9, wherein the connecting member connects the pair of arms to the proximal end portions of the sliding pins.

11. The locking device of claim 9, wherein distal end portions of the connecting members expand into a spherical shape.

12. The locking device of claim 7, wherein the pair of arms includes connecting members for connection with the proximal end portions of the pair of sliding pins, and wherein distal end portions of the connecting members expand into a spherical shape.

13. The locking device of claim 7, wherein the proximal end portions of the pair of sliding pins include a recess portion, and wherein a width of the recess portion in the lengthwise direction of the sliding pin is substantially equal to a width of the distal end portions of the corresponding arms in the lengthwise direction of the sliding pin.

14. The locking device of claim 7, wherein the proximal end portions of the pair of sliding pins include a recess portion, and wherein a width of the recess portion in a direction perpendicular to the lengthwise direction of the sliding pin is larger than a width of the distal end portions of the corresponding arms in the direction perpendicular to the lengthwise direction of the sliding pin.

15. The locking device of claim 7, wherein the proximal end portions of the pair of sliding pins include a recess portion, wherein a width of the recess portion in the lengthwise direction of the sliding pin is substantially equal to a width of the distal end portions of the corresponding arms in the lengthwise direction of the sliding pin, and wherein a width of the recess portion in the direction perpendicular to the lengthwise direction of the sliding pin is larger than a width of the distal end portions of the corresponding arms in a direction perpendicular to the lengthwise direction of the sliding pin.

16. The locking device of claim 7, wherein the pair of arms include connecting members disposed at each of the distal end portions of the pair of arms, wherein distal end portions of the connecting members expand into a spherical shape, wherein the proximal end portions of the pair of sliding pins include a recess portion, and wherein a width of the recess portion in the direction perpendicular to the lengthwise direction of the sliding pin is larger than a diameter of the spherical shape of the connecting member.

17. The locking device of claim 7, wherein the pair of arms includes connecting members disposed at each of the distal end portions of the pair of arms, wherein distal end portions of the connecting members expand into a spherical shape, wherein the proximal end portions of the pair of sliding pins include a recess portion, wherein a width of the recess portion in the lengthwise direction of the sliding pin is substantially equal to a diameter of the spherical shape of the connecting member, and wherein a width of the recess portion in the direction perpendicular to the lengthwise direction of the sliding pin is larger than a diameter of the spherical shape of the connecting member.

18. The locking device of claim 7, wherein the proximal end portions of the pair of sliding pins include a recess portion, wherein a width of the recess portion in the lengthwise direction of the sliding pins is substantially equal to a diameter of the spherical shape of the connecting member so as to have no play in the lengthwise direction of the sliding pins, and wherein a width of the recess portion in a direction perpendicular to the lengthwise direction of the sliding pins is greater than the diameter of the spherical shape of the connecting member so as to have a given play in the direction perpendicular to the lengthwise direction.

* * * * *